US007420451B2

(12) United States Patent
Lee

(10) Patent No.: US 7,420,451 B2
(45) Date of Patent: Sep. 2, 2008

(54) SYMMETRICAL DIFFERENTIAL INDUCTOR

(75) Inventor: Sheng-Yuan Lee, Taipei Hsien (TW)

(73) Assignee: VIA Technologies Inc., Taipei Hsien (TW)

( * ) Notice: Subject to any disclaimer, the term of this patent is extended or adjusted under 35 U.S.C. 154(b) by 14 days.

(21) Appl. No.: 11/691,152

(22) Filed: Mar. 26, 2007

(65) Prior Publication Data

US 2008/0174394 A1 Jul. 24, 2008

(30) Foreign Application Priority Data

Jan. 24, 2007 (TW) ..... 96102658 A

(51) Int. Cl.
*H01F 5/00* (2006.01)

(52) U.S. Cl. ..... 336/200

(58) Field of Classification Search ..... 336/65, 336/83, 200, 206–208, 232; 257/531
See application file for complete search history.

(56) References Cited

U.S. PATENT DOCUMENTS 6,801,114 B2 * 10/2004 Yang et al. ..... 336/200
6,867,677 B2 * 3/2005 Nielson ..... 336/200
6,972,658 B1 * 12/2005 Findley et al. ..... 336/200
7,042,326 B2 * 5/2006 Gau ..... 336/200
2004/0217839 A1 * 11/2004 Haaren et al. ..... 336/200

* cited by examiner

*Primary Examiner*—Tuyen T. Nguyen
(74) *Attorney, Agent, or Firm*—J.C. Patents

(57) ABSTRACT

A symmetrical differential inductor including a first spiral conducting wire and a second spiral conducting wire is provided. The first spiral conducting wire has a first end and a second end, and the second end whirls in spiral fashion towards a central portion of a spiral structure of the first spiral conducting wire. The second spiral conducting wire and the first spiral conducting wire are interwound with each other and symmetrical to a symmetrical plane. The second spiral conducting wire has a third end and a fourth end, and the fourth end whirls in spiral fashion towards a central portion of a spiral structure of the second spiral conducting wire and is connected to the second end of the first spiral conducting wire. When the first spiral conducting wire and the second spiral conducting wire having the same distance from the substrate are staggered, they extend towards the substrate.

20 Claims, 5 Drawing Sheets

SYMMETRICAL DIFFERENTIAL INDUCTOR

CROSS-REFERENCE TO RELATED APPLICATION

This application claims the priority benefit of Taiwan application serial no. 96102658, filed Jan. 24, 2007. All disclosure of the Taiwan application is incorporated herein by reference.

BACKGROUND OF THE INVENTION

1. Field of the Invention

The present invention relates to an inductor. More particularly, the present invention relates to a symmetrical differential inductor.

2. Description of Related Art

Inductor is an important passive component, which is usually applied in radio frequency (RF) circuits, voltage controlled oscillators (VCOs), low noise amplifiers (LNAs), or power amplifiers (PAs), etc.

The magnitude of the inductance is usually relevant to the number of turns of the winded conducting wire, the geometric shape, and the material of the magnetic core. Quality factor (Q factor), i.e., Q value is a key index for determining the performance of the inductor. The general formula for the Q factor is shown as follows:

$$Q=(\text{stored electrical energy})/(\text{consumed electrical energy}).$$

It is known from the above general formula that, either increasing the stored electrical energy or decreasing the consumed electrical energy can enhance the Q value, so as to improve the performance of the inductor.

According to the signal transmission mode, the inductors may be divided into single-ended inductors and differential inductors. Generally, the differential inductor is usually a symmetrical spiral structure. In such a structure, the differential inductor usually has two ports, and voltages with opposite electrical properties and the same absolute value are applied on the two ports respectively. However, during the operation of the differential inductor, since the conducting wires of the symmetrical spiral structure are adjacent to each other, but have opposite electrical properties, a relatively large parasitic capacitance is generated between the neighboring conducting wires. In this way, the generated parasitic capacitance increases the consumed electrical energy; as a result, the Q value of the differential inductor reduces.

SUMMARY OF THE INVENTION

Accordingly, the present invention is directed to a symmetrical differential inductor, which is capable of effectively reducing the parasitic capacitance generated between the conducting wires of the inductor.

The present invention provides a symmetrical differential inductor, disposed on a substrate. The symmetrical differential inductor includes a first spiral conducting wire and a second spiral conducting wire. The first spiral conducting wire has a first end and a second end, and the second end whirls in spiral fashion towards a central portion of a spiral structure of the first spiral conducting wire. The second spiral conducting wire and the first spiral conducting wire are interwound with each other and symmetrical to a symmetrical plane. The second spiral conducting wire has a third end and a fourth end, and the fourth end whirls in spiral fashion towards a central portion of a spiral structure of the second spiral conducting wire and is connected to the second end of the first spiral conducting wire. When the first spiral conducting wire and the second spiral conducting wire whirl inside, and the first spiral conducting wire and the second spiral conducting wire having the same distance from the substrate are staggered, they extend towards the direction of the substrate to shorten the distances between them and the substrate.

The present invention provides another symmetrical differential inductor, disposed on a substrate. The symmetrical differential inductor includes a first spiral conducting wire and a second spiral conducting wire. The first spiral conducting wire at least includes a first outer conducting wire and a first inner conducting wire those are electrically connected in serial with each other, and the first inner conducting wire whirls in spiral fashion towards a central portion of a spiral structure of the first spiral conducting wire. The second spiral conducting wire and the first spiral conducting wire are interwound with each other and symmetrical to a symmetrical plane. The second spiral conducting wire at least includes a second outer conducting wire and a second inner conducting wire those are electrically connected in serial with each other, and the second inner conducting wire whirls in spiral fashion towards a central portion of a spiral structure of the second spiral conducting wire and connected to the first inner conducting wire of the first spiral conducting wire. The first outer conducting wire and the second outer conducting wire are disposed at a first height position corresponding to the substrate, the first inner conducting wire and the second inner conducting wire are disposed at a second height position corresponding to the substrate, and the first height position is higher than the second height position. The first spiral conducting wire and the second spiral conducting wire enter the second height position from the first height position at a staggering position of the first spiral conducting wire and the second spiral conducting wire.

In order to make the aforementioned and other aspects, features, and advantages of the present invention comprehensible, preferred embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
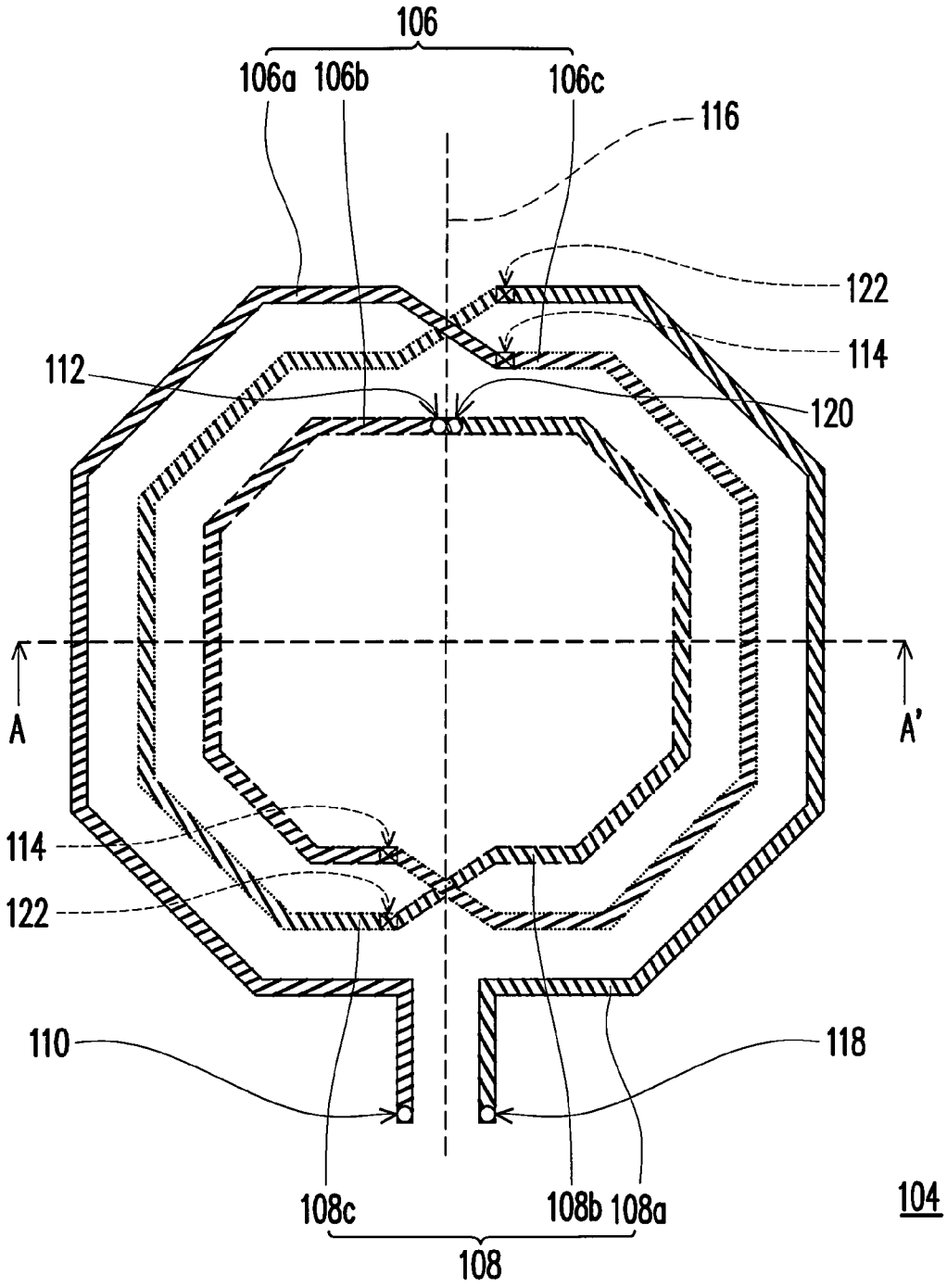
FIG. 1 is a top view of a symmetrical differential inductor according to an embodiment of the present invention.
Figure 2A:
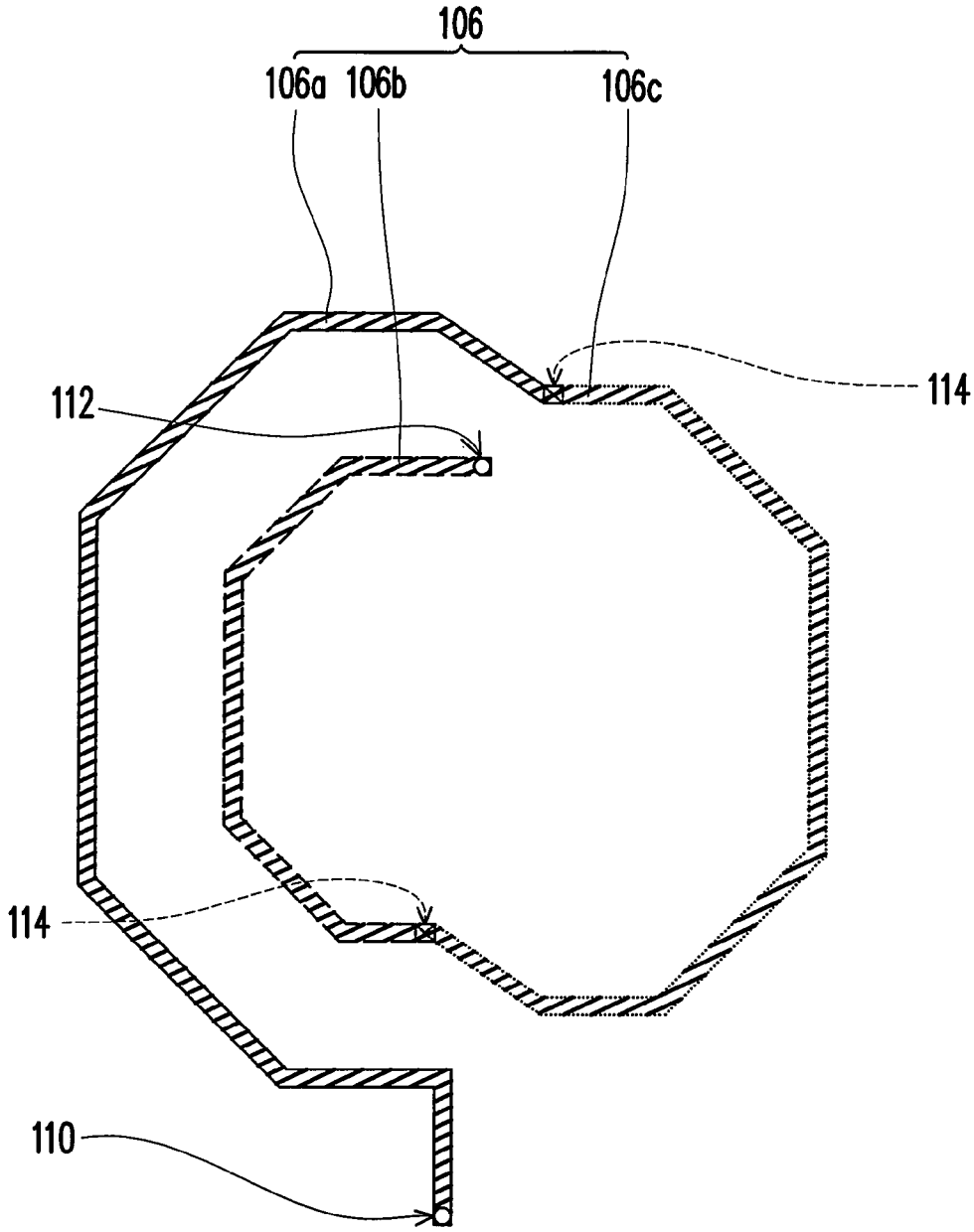
FIGS. 2A and 2B are respectively top views of spiral conducting wires 106 and 108.
Figure 2B:
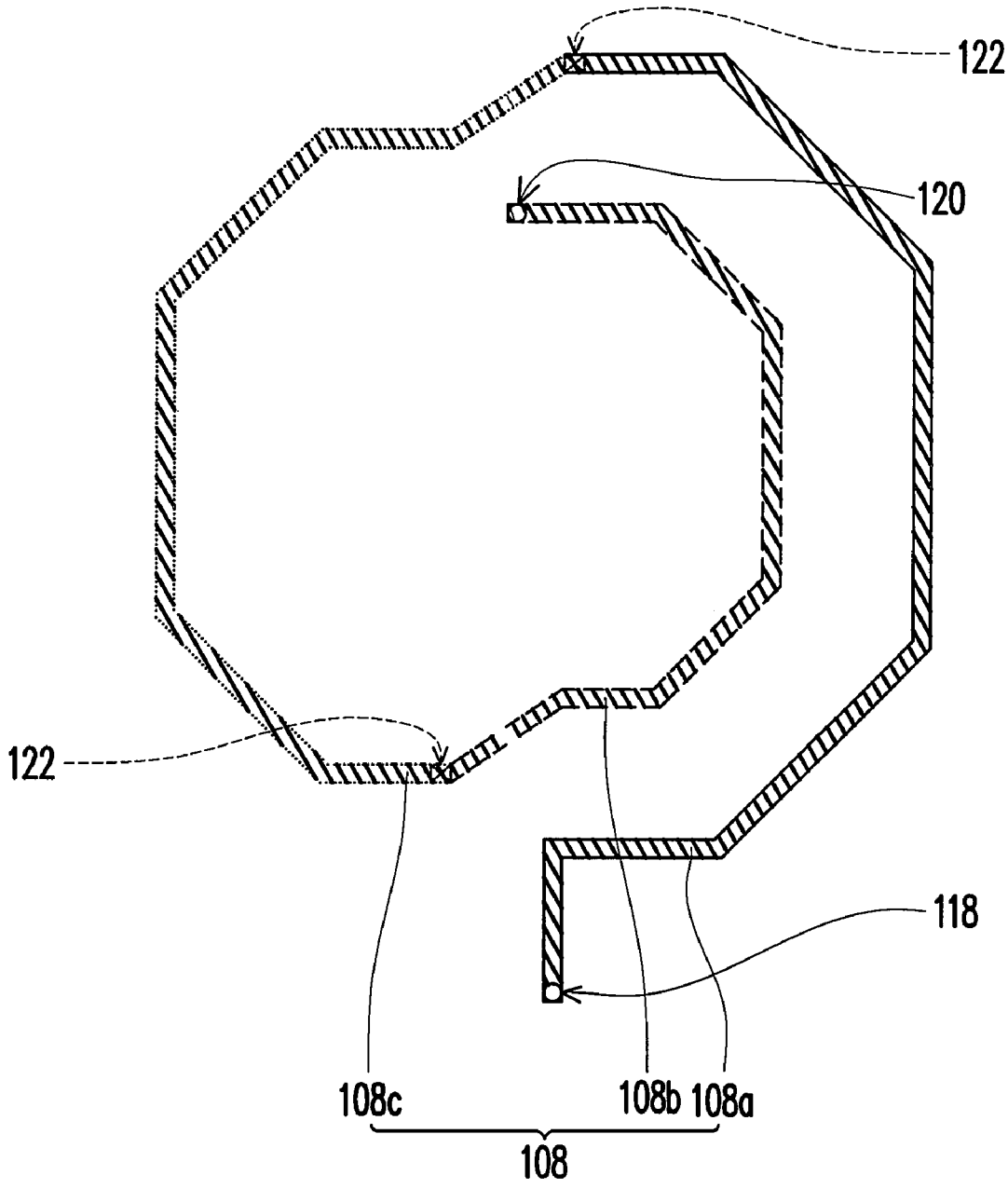
Figure 3:
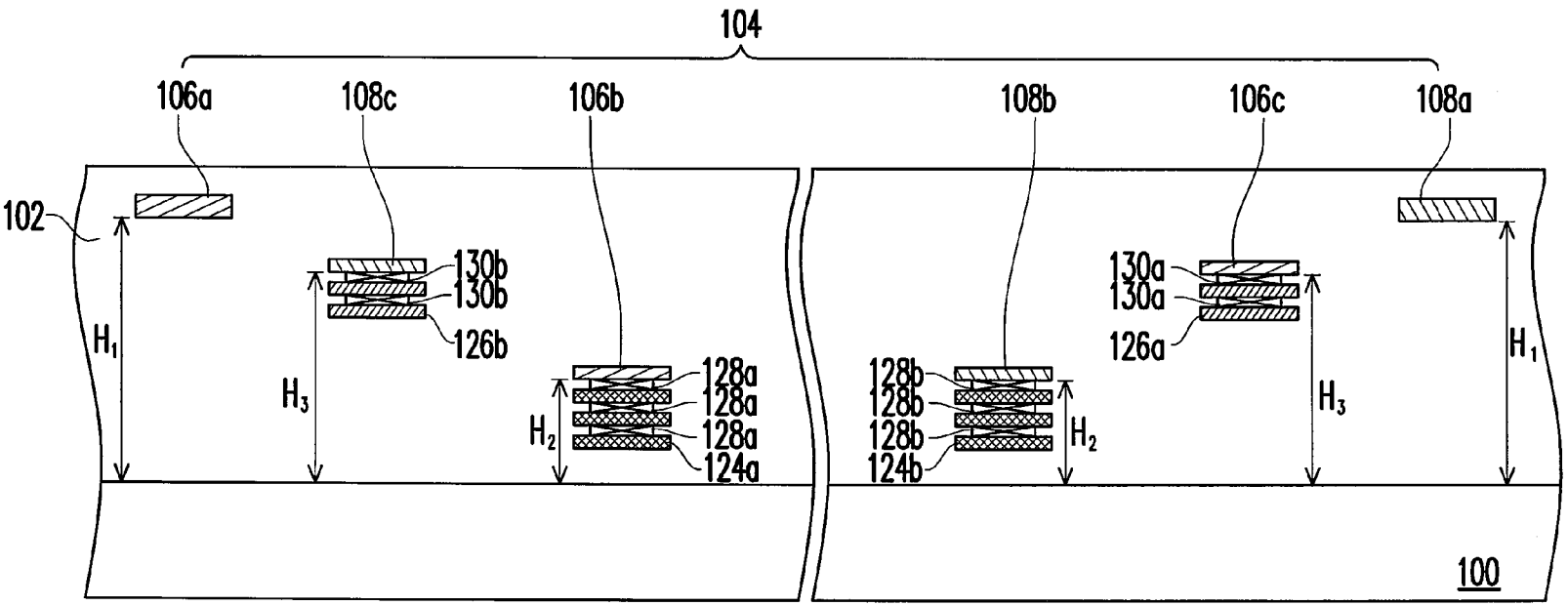
FIG. 3 is a cross-sectional view of FIG. 1 taken along a section line A-A'.
Figure 4:
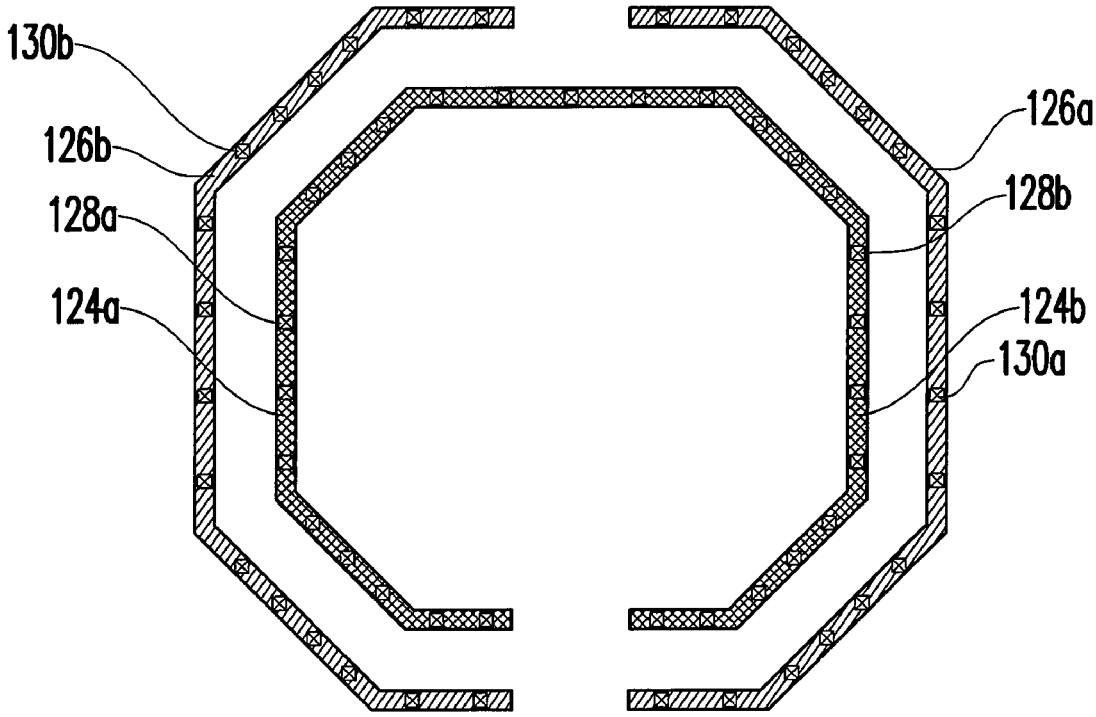
FIG. 4 is a top view of a gain conducting wire.

FIG. 1 is a top view of a symmetrical differential inductor according to an embodiment of the present invention. FIGS. 2A and 2B are top views of a first spiral conducting wire 106 and a second spiral conducting wires 108 respectively. FIG. 3 is a cross-sectional view of FIG. 1 taken along a section line A-A'. FIG. 4 is a top view of a gain conducting wire.

Referring to FIGS. 1, 2A, 2B, 3, and 4, a symmetrical differential inductor 104 is disposed in a dielectric layer 102 on a substrate 100. The symmetrical differential inductor 104 is fabricated through a semiconductor manufacturing process, so the substrate 100 can be made of a silicon-based material. The symmetrical differential inductor 104 includes spiral conducting wires 106 and 108. The dielectric layer 102 is made of a dielectric material, for example, such as silica, and each conducting wire may be fabricated by copper and aluminum copper alloy, etc.

The spiral conducting wire 106 at least includes an outer conducting wire 106*a* and an inner conducting wire 106*b* those are electrically connected in serial with each other. The spiral conducting wire 106 has a first end 110 and a second end 112. The first end 110 is located on the outer conducting wire 106*a*, the second end 112 is located on the inner conducting wire 106*b*, and the second end 112 of the inner conducting wire 106*b* whirls in spiral fashion towards a central portion of a spiral structure of the spiral conducting wire 106. The spiral conducting wire 106 is made of metal, for example, such as copper.

In this embodiment, the winding structure of the symmetrical differential inductor 104 is, for example, a three-turn structure. The spiral conducting wire 106 further includes a connecting conducting wire 106*c* made of metal, for example, such as copper. The process for electrically connecting in serial the outer conducting wire 106*a* to the inner conducting wire, 106*b* is, for example, achieved through utilizing the connecting conducting wire 106*c* and a via 114, but it is not intended to limit the present invention. In another embodiment, for example, if the winding structure of the symmetrical differential inductor 104 is a two-turn structure, the outer conducting wire 106*a* and the inner conducting wire 106*b* are directly connected with each other through the via. In addition, if the winding structure of the symmetrical differential inductor 104 has more than three turns, the outer conducting wire 106*a* and the inner conducting wire 106*b* are electrically connected in serial with each other through a plurality of connecting conducting wires 106*c* and a plurality of vias 114.

The spiral conducting wires 108 and 106 are interwound with each other and symmetrical to a symmetrical plane 116, and the extending direction of the symmetrical plane 116 faces towards the inner side of the plane. The spiral conducting wire 108 at least includes an outer conducting wire 108*a* and an inner conducting wire 108*b* those are electrically connected in serial with each other. The spiral conducting wire 108 has a third end 118 and a fourth end 120. The third end 118 is located on the outer conducting wire 108*a*, the fourth end 120 is located on the inner conducting wire 108*b*, and the fourth end 120 of the inner conducting wire 108*b* whirls in spiral fashion towards a central portion of a spiral structure of the spiral conducting wire 108 and connected to the second end 112 of the inner conducting wire 106*b* of the spiral conducting wire 106. The spiral conducting wire 108 is made of the metal, for example, copper.

Accordingly, a voltage applied on the outer conducting wire 106*a* and a voltage applied on the outer conducting wire 108*a* have the same absolute value, but opposite in electrical property, and the absolute value of the voltage is gradually reduced, as it is closer to the inner part of the spiral conducting wires 106 and 108. In addition, the connecting intersection position for the second end 112 of the inner conducting wire 106*b* and the fourth end 120 of the inner conducting wire 108*b* may be virtually grounded, and at this time, the voltage value is 0.

In this embodiment, the winding structure of the symmetrical differential inductor 104 is, for example, a three-turn structure. The spiral conducting wire 108 further includes a connecting conducting wire 108*c* made of the metal, for example, copper. The process for electrically connecting in serial the outer conducting wire 108*a* and the inner conducting wire 108*b* is, for example, achieved through utilizing the connecting conducting wire 108*c* and a via 122, but it is not intended to limit the present invention. In another embodiment, for example, if the winding structure of the symmetrical differential inductor 104 is a two-turn structure, the outer conducting wire 108*a* and the inner conducting wire 108*b* are directly connected with each other through the via. In addition, if the winding structure of the symmetrical differential inductor 104 has more than three turns, the outer conducting wire 108*a* and the inner conducting wire 108*b* are electrically connected in serial through a plurality of connecting conducting wires 108*c* and a plurality of vias 122.

In addition, the spiral conducting wires 106 and 108 do not contact with each other at the staggering position, so as to avoid the short circuit. The process for preventing the spiral conducting wires 106 and 108 from contacting with each other at the staggering position is, for example, connecting the outer conducting wire 108*a* of the spiral conducting wire 108 to the connecting conducting wire 108*c* through the via 122, such that the spiral conducting wire 108 enters the dielectric layer 102 located there below, and passes below the outer conducting wire 106*a*. On the other hand, the outer conducting wire 106*a* of the spiral conducting wire 106 passes above the connecting conducting wire 108*c*, and is connected to the connecting conducting wire 106*c* through the via 114, such that the spiral conducting wire 106 enters into the dielectric layer 102 located there below.

Furthermore, based on the substrate 100, the outer conducting wires 106*a* and 108*a* are disposed at a height position $H_1$, the inner conducting wires 106*b* and 108*b* are disposed at a height position $H_2$, and the connecting conducting wires 106*c* and 108*c* are disposed at a height position $H_3$. The height position $H_1$ is higher than the height position $H_2$, and the height position $H_3$ is located between the height position $H_1$ and the height position $H_2$.

Therefore, the spiral conducting wires 106 and 108 firstly enter the height position $H_3$ from the height position $H_1$ and then enter the height position $H_2$ from the height position $H_3$ at the staggering position of the spiral conducting wires 106 and 108, and the staggering position of the spiral conducting wires 106 and 108 is, for example, located on the symmetrical plane 116. In other words, when the spiral conducting wires 106 and 108 located on the same height position are staggered with each other, the spiral conducting wires 106 and 108 may extend towards another relatively lower height position, so as to shorten the distance between the spiral conducting wires 106 and 108 from the substrate 100. In this manner, the mutually interwound spiral conducting wires 106 and 108 are made to be located on different horizontal planes, so as to prevent the parasitic capacitance from being generated between the conducting wires. For example, the heights of the outer conducting wire 106*a*, the connecting conducting wire 108*c*, and the inner conducting wire 106*b* from the substrate 100 have been gradually reduced, so as to prevent the parasitic capacitance from being generated between the outer conducting wire 106*a*, the connecting conducting wire 108*c*, and the inner conducting wire 106*b*.

It should be noted that, the symmetrical differential inductor 104 further includes gain conducting wires 124*a*, 124*b*, 126*a*, and 126*b*, for increasing the cross section area of the symmetrical differential inductor 104, so as to reduce the conductor loss. The gain conducting wires 124*a*, 124*b*, 126*a*, and 126*b* are made of the metal, for example, such as copper.

The gain conducting wire 124*a* is disposed between the inner conducting wire 106*b* and the substrate 100, corresponding to the projection of the inner conducting wire 106*b*, and the gain conducting wire 124*a* is electrically connected in parallel with the inner conducting wire 106*b*, for example, through at least two vias 128*a*, so as to connect the two ends of the inner conducting wire 106*b*. If a plurality of gain conducting wires 124*a* exists, these two gain conducting wires 124*a* which are upper and lower neighboring are electrically connected in parallel, for example, through at least two vias 128*a*. In this embodiment, three gain conducting wires 124*a* are disposed under the inner conducting wire 106*b*.

On the other hand, the gain conducting wire 124*b* may be meanwhile disposed between the inner conducting wire 108*b* and the substrate 100 corresponding to the inner conducting wire 108*b*, and the gain conducting wire 124*b* is electrically connected in parallel with the inner conducting wire 108*b*, for example, through at least two vias 128*b*, so as to connect the two ends of the inner conducting wire 108*b*. If a plurality of gain conducting wires 124*b* exists, these two gain conducting wires 124*b* which are upper and lower neighboring are electrically connected in parallel, for example, through the via 128*b*. In this embodiment, three gain conducting wires 124*b* are disposed under the inner conducting wire 108*b*. It should be noted that, when the gain conducting wires 124*a* and 124*b* are respectively disposed corresponding to the inner conducting wires 106*b* and 108*b*, one end point of the two gain conducting wires 124*a* and 124*b* on the same horizontal plane may be connected to each other.

The gain conducting wire 126*a* is disposed under the connecting conducting wire 106*c* corresponding to the projection of the connecting conducting wire 106*c*, and the position where the gain conducting wire 126*a* is located is not lower than the height position $H_2$, that is, between the height position $H_3$ and the height position $H_2$. The gain conducting wire 126*a* is electrically connected in parallel with the connecting conducting wire 106*c*, for example, through at least two vias 130*a*, so as to connect the two ends of the connecting conducting wire 106*c*. If a plurality of gain conducting wires 126*a* exists, these two gain conducting wires 126*a* which are upper and lower neighboring are electrically connected in parallel, for example, through the via 130*a*. In this embodiment, two gain conducting wires 126*a* are disposed under the connecting conducting wire 106*c*.

On the other hand, the gain conducting wire 126*b* is disposed under the connecting conducting wire 108*c* corresponding to the projection of the connecting conducting wire 108*c*, and the position where the gain conducting wire 126*b* is located is not lower than the height position $H_2$, that is, between the height position $H_3$ and the height position $H_2$. The gain conducting wire 126*b* is electrically connected in parallel with the connecting conducting wire 108*c*, for example, through at least two vias 130*b*, so as to connect the two ends of the connecting conducting wire 108*c*. If a plurality of gain conducting wires 126*b* exists, these two gain conducting wires 126*b* which are upper and lower neighboring are electrically connected in parallel, for example, through the via 130*b*. In this embodiment, two gain conducting wires 126*b* are disposed under the connecting conducting wire 108*c*. It should be noted that, when the gain conducting wires 126*a* and 126*b* are respectively disposed corresponding to the connecting conducting wires 106*c* and 108*c*, and the two gain conducting wires 126*a* and 126*b* on the same horizontal plane do not connect to each other.

Based on the above descriptions, in the symmetrical differential inductor 104, when the spiral conducting wires 106 and 108 on the same height position are staggered with each other, the spiral conducting wires 106 and 108 may extend towards another relatively lower height position, so each conducting wire in the symmetrical differential inductor 104 is not located on the same horizontal plane, so as to avoid the parasitic capacitance from being generated between the conducting wires. In this manner, the symmetrical differential inductor 104 can reduce the electrical energy consumption caused by the parasitic capacitance, so as to improve the Q value.

In addition, the gain conducting wires 124*a*, 124*b*, 126*a*, and 126*b* may increase the cross section area of the symmetrical differential inductor 104, so as to reduce the conductor loss, which is helpful for the performance of the symmetrical differential inductor 104. The gain conducting wires 124*a*, 124*b*, 126*a*, and 126*b* are not located on the same horizontal plane as other conducting wires, so the cross section area of the symmetrical differential inductor 104 can be increased, without increasing the parasitic capacitance generated between the conducting wires.

To sum up, the present invention at least has the following advantages.

1. The conducting wires of the symmetrical differential inductor provided by the present invention are not adjacent to each other, so as to prevent the parasitic capacitance from being generated between the conducting wires, and thereby reducing the electrical energy consumption caused by the parasitic capacitance, and improving the Q value.

2. When the symmetrical differential inductor provided by the present invention has the gain conducting wire, the cross section area of the symmetrical differential inductor is increased, so as to reduce the conductor loss, and to increase the performance of the symmetrical differential inductor.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A symmetrical differential inductor, disposed on a substrate, comprising:

a first spiral conducting wire, having a first end and a second end, wherein the second end whirls in spiral fashion towards a central portion of a spiral structure of the first spiral conducting wire; and a second spiral conducting wire, having a third end and a fourth end, wherein the fourth end whirls in spiral fashion towards a central portion of a spiral structure of the second spiral conducting wire and is connected to the second end of the first spiral conducting wire, and the second spiral conducting wire and the first spiral conducting wire are interwound with each other, and symmetrical to a symmetrical plane, wherein when the first spiral conducting wire and the second spiral conducting wire whirl inside, and the first spiral conducting wire and the second spiral conducting wire having the same distance from the substrate are staggered, the first spiral conducting wire and the second spiral conducting wire extend towards the direction of the substrate to shorten the distances between the first spiral conducting wire and the second spiral conducting wire and the substrate.

2. The symmetrical differential inductor as claimed in claim 1, wherein a staggering position of the first spiral conducting wire and the second spiral conducting wire comprises a position located on the symmetrical plane.

3. The symmetrical differential inductor as claimed in claim 1, wherein the first spiral conducting wire and the second spiral conducting wire do not contact with each other at the staggering position.

4. The symmetrical differential inductor as claimed in claim 1, wherein a voltage applied on the first end and a voltage applied on the third end have the same absolute value, but opposite in electrical property.

5. The symmetrical differential inductor as claimed in claim 1, further comprising at least one first gain conducting wire, corresponding to a projection of the first spiral conducting wire closer to the substrate, disposed between the first spiral conducting wire and the substrate, and electrically connected in parallel with the first spiral conducting wire.

6. The symmetrical differential inductor as claimed in claim 5, further comprising at least one second gain conducting wire, corresponding to a projection of the second spiral conducting wire closer to the substrate, disposed between the second spiral conducting wire and the substrate, and electrically connected in parallel with the second spiral conducting wire.

7. The symmetrical differential inductor as claimed in claim 1, wherein a material of the symmetrical differential inductor comprises metal.

8. A symmetrical differential inductor, disposed on a substrate, comprising:

a first spiral conducting wire, at least having a first outer conducting wire and a first inner conducting wire electrically connected in serial with each other, wherein the first inner conducting wire whirls in spiral fashion towards a central portion of a spiral structure of the first spiral conducting wire; and a second spiral conducting wire, at least having a second outer conducting wire and a second inner conducting wire electrically connected in serial with each other, wherein the second inner conducting wire whirls in spiral fashion towards a central portion of a spiral structure of the second spiral conducting wire and is connected to the first inner conducting wire of the first spiral conducting wire, and the second spiral conducting wire and the first spiral conducting wire are interwound with each other and symmetrical to a symmetrical plane, wherein the first outer conducting wire and the second outer conducting wire are disposed on a first height position corresponding to the substrate, the first inner conducting wire and the second inner conducting wire are disposed on a second height position corresponding to the substrate, and the first height position is higher than the second height position, and the first spiral conducting wire and the second spiral conducting wire enter the second height position from the first height position, at a staggering position of the first spiral conducting wire and the second spiral conducting wire.

9. The symmetrical differential inductor as claimed in claim 8, wherein the staggering position of the first spiral conducting wire and the spiral conducting wire comprises a position located on the symmetrical plane.

10. The symmetrical differential inductor as claimed in claim 8, wherein the first spiral conducting wire and the second spiral conducting wire do not contact with each other at the staggering position.

11. The symmetrical differential inductor as claimed in claim 8, wherein a voltage applied on the first outer conducting wire and a voltage applied on the second outer conducting wire have the same absolute value, but opposite in electrical property.

12. The symmetrical differential inductor as claimed in claim 8, further comprising at least one first gain conducting wire, corresponding to a projection of the first inner conducting wire, disposed between the first inner conducting wire and the substrate, and electrically connected in parallel with the first inner conducting wire.

13. The symmetrical differential inductor as claimed in claim 12, further comprising at least one second gain conducting wire, corresponding to a projection of the second spiral conducting wire, disposed between the second inner conducting wire and the substrate, and electrically connected in parallel with the second inner conducting wire.

14. The symmetrical differential inductor as claimed in claim 8, wherein the first spiral conducting wire further comprises at least one first connecting conducting wire, for connecting the first outer conducting wire to the first inner conducting wire, and the second spiral conducting wire further comprises at least one second connecting conducting wire, for connecting the second outer conducting wire to the second inner conducting wire, wherein the first connecting conducting wire and the second connecting conducting wire are disposed at a third height position corresponding to the substrate, and the third height position is located between the first height position and the second height position, and the first spiral conducting wire and the second spiral conducting wire firstly enter the third height position from the first height position and then enter the second height position from the third height position, at the staggering position of the first spiral conducting wire and the second spiral conducting wire.

15. The symmetrical differential inductor as claimed in claim 14, wherein the staggering position of the first spiral conducting wire and the second spiral conducting wire comprises a position located on the symmetrical plane.

16. The symmetrical differential inductor as claimed in claim 14, wherein the first spiral conducting wire and the second spiral conducting wire do not contact with each other at the staggering position.

17. The symmetrical differential inductor as claimed in claim 14, further comprising at least one first gain conducting wire, corresponding to a projection of the first inner conducting wire, disposed between the first inner conducting wire and the substrate, and connected electrically in parallel with the first inner conducting wire.

18. The symmetrical differential inductor as claimed in claim 17, further comprising at least one second gain conducting wire, corresponding to a projection of the second inner conducting wire, disposed between the second inner conducting wire and the substrate, and electrically connected in parallel with the second inner conducting wire.

19. The symmetrical differential inductor as claimed in claim 14, further comprising at least one first gain conducting wire, corresponding to a projection of the first connecting conducting wire, disposed under the first connecting conducting wire, electrically connected in parallel with the first connecting conducting wire, and located at a position not lower than the second height.

20. The symmetrical differential inductor as claimed in claim 19, further comprising at least one second gain conducting wire, corresponding to a projection of the second connecting conducting wire, disposed under the second connecting conducting wire, electrically connected in parallel with the second connecting conducting wire, and located at a position not lower than the second height.

* * * * *